US006228288B1

(12) United States Patent
Chacko

(10) Patent No.: US 6,228,288 B1
(45) Date of Patent: May 8, 2001

(54) ELECTRICALLY CONDUCTIVE COMPOSITIONS AND FILMS FOR POSITION SENSORS

(75) Inventor: Antony P. Chacko, Granger, IN (US)

(73) Assignee: CTS Corporation, Elkhart, IN (US)

( * ) Notice: Subject to any disclaimer, the term of this patent is extended or adjusted under 35 U.S.C. 154(b) by 0 days.

(21) Appl. No.: 09/559,856

(22) Filed: Apr. 27, 2000

(51) Int. Cl.[7] ..... H01B 1/22; H01B 1/24

(52) U.S. Cl. ..... 252/511; 252/512; 252/514; 428/922

(58) Field of Search ..... 252/511, 512, 252/513, 514; 428/357, 922

(56) References Cited

U.S. PATENT DOCUMENTS

| | | | | |
|---|---|---|---|---|
| 4,599,383 | * | 7/1986 | Satoji | 525/180 |
| 4,882,089 | * | 11/1989 | Iwaskow et al. | 428/242 |
| 5,250,227 | | 10/1993 | Margolin | 252/511 |
| 5,840,432 | * | 11/1998 | Hirai et al. | 428/570 |
| 5,855,820 | | 1/1999 | Chan | 252/511 |
| 5,897,813 | | 4/1999 | Titomir | 252/511 |
| 6,010,646 | | 1/2000 | Schleifstein | 252/500 |

* cited by examiner

*Primary Examiner*—Mark Kopec
(74) *Attorney, Agent, or Firm*—Mark P. Bourgeois; Mark W. Borgman

(57) ABSTRACT

The present invention is a polymer film conductive composition comprising, based on total composition: (a) 3–20 wt. % of polyamide-imide resin; (b) 0–10 wt. % cyanate ester resin; (c) 40–85 wt. % finely divided metallic electrically conductive particles selected from the group consisting of silver, copper, nickel, silver coated copper, silver coated nickel, carbon black, graphite and mixtures thereof, wherein all of (a), (b) and (c) are dispersed in a 20–40 wt. % organic solvent.

20 Claims, No Drawings

ELECTRICALLY CONDUCTIVE COMPOSITIONS AND FILMS FOR POSITION SENSORS

BACKGROUND OF THE INVENTION

1. Field of the Invention

This invention generally relates to polymer thick film conductive compositions. In particular, the invention is directed to such compositions, which are suitable for making position sensing elements.

2. Description of the Related Art

Electrically conductive polymer thick film compositions have numerous applications. Polymer thick film (PTF) conductive compositions are screenable pastes, which are used to form conductive elements in electronic applications. Such compositions contain conductive filler material dispersed in polymeric resins, which remain an integral part of the final composition after processing.

Electrically conductive compositions are used as conductive elements in variable resistors, potentiometers, and position sensor applications.

A Position sensor includes one or more voltage indicating position sensing variable resistor elements. These resistor elements are also prepared from polymer thick film materials. The resistive element is in most cases printed over a conductive element which acts as the collector element. In position sensing applications, a metallic wiper slides over the resistive element. The wiper can slide back and forth for several million cycles over the collector and resistive elements during the lifetime of the electronic component.

For accurate position sensing, the wiper should give continuous electrical output throughout the life of the sensor. The durability of these position-sensing elements depends on the mechanical properties of both the resistor and the conductive film. The polymer thick films tend to wearout after several million cycles of sliding with a metallic contactor over the elements at extreme temperature conditions typically seen in an environment such as an automotive engine compartment. Polymer resistive and conductive compositions having excellent mechanical properties are required for performance and signal output in these applications.

In addition to good mechanical properties, these materials should also have good thermal properties. Polymer thick films show a decrease in storage modulus as temperature is increased. A sharp decrease in mechanical properties is observed near the glass transition temperature. In addition to loss in modulus, these materials also tend to show an increase in coefficient of thermal expansion, which increases significantly above the glass transition temperature. A position sensor is exposed to high temperatures in under the hood applications. At these temperatures elements show a high rate of wear due to a decrease in modulus properties. In addition to the surrounding temperature, a still higher temperature is observed at the interface between the metallic wiper and the element surface due to frictional heating. In some cases these temperatures can approach the glass transition temperature (tg) of the material and can cause loss of the mechanical properties, which adversely affect the signal output. Polymer thick film materials prepared from polymers with higher glass transition temperature would be expected to perform better for these applications.

Another important property desired of these materials is a strong adhesion to the substrate as well as to the resistive materials. A loss in adhesion can cause accelerated wear or chipping of the conductive film. In automotive applications, lubricants used in other components may come into contact with the sensor and can diffuse into the interface between the substrate and conductive film. This diffusion of the lubricant fluids can lead to a loss in adhesion of the conductive film to the substrate. A strongly bonded conductive material to the substrate can prevent this diffusion of the lubricant into the interface. For similar reasons as described above, conductive materials should have a strong interfacial bond to the resistive elements.

Substrate materials used in position sensor applications vary from polyimide, phenolic, FRP, ceramic, etc. In order to increase adhesion of the conductive materials to the substrates, some sensor manufacturers plasma treat the substrate surface to create an active surface to bond with the conductive elements. The plasma treatment is an expensive process step and an avoidance of this process step can lead to significant cost savings. Functional groups, which can create strong adhesive bonds with substrates even without a plasma treatment, are preferred for cost saving and other performance requirements.

Flexible position sensing elements such as polymer thick films on polyimide substrates undergo numerous back bending, forward bending, creasing, twisting, and other mechanically harsh process steps. A conductive material of brittle nature can fail during these operations. The cracks as a result of deformation cause a severe decrease in conductivity and other electrical and mechanical properties. A conductive element prepared from a flexible polymer is preferred for these applications.

A smooth surface of the conductive element is desired for improved electrical properties. The position sensing elements are expected to show low linearity deviation before and during the lifetime of these components. A smooth conductive surface contributes to low microgradient. Another requirement for position sensors is low linearity deviation. A highly conductive element would give low linearity deviation Higher molecular weight of the polymers and low average particle size of conductive particles can contribute to desired rheological properties which results in low surface roughness. Lubricants are generally applied over the resistor and collector elements and tribological properties of the lubricants are often determined by the surface roughness of the resistor and collector elements. A smooth collector surface is desired.

A good processing flexibility is desired for application of a conductive composition onto a variety of substrate materials. A low curing temperature is required for phenolic and epoxy reinforced FRP materials, where as ceramic and kapton substrates can be cured at higher temperatures. It is desirable to have a conductive composition that can be cured at a wide range of temperatures. A short cure time is desirable due to both substrate limitations and processing costs.

Another desirable property for a conductive composition is a long shelf life. A change in viscosity during storage can affect the processability and result in poor printing qualities. This can also lead to position sensing elements with widely varying performance.

A current unmet need exists for a conductive composition that can meet the above mentioned necessary attributes.

SUMMARY

The present invention is a polymer film conductive composition comprising, based on total composition:

a) 3–20 wt. % of polyamide-imide resin;
b) 0–10 wt. % cyanate ester resin; and
c) 40–85 wt. % finely divided metallic electrically conductive particles selected from the group consisting of silver, copper, nickel, silver coated copper, silver coated nickel, carbon black, graphite and mixtures thereof, wherein all of (a), (b) and (c) are dispersed in a 20–40 wt. % organic solvent.

DETAILED DESCRIPTION OF THE PREFFERED EMBODIMENT(S)

1. Polymer Components

The polymer components used in the present invention comprises 3–20 wt. % of a high Tg polyamide-imide polymer and 0–10 wt. % cyanate ester resin based upon total composition. The polymers are dissolved in an organic solvent.

Polyamide-imide polymers are commercially available from BP Amoco. In the electrically conductive composition of the present invention, Polyamide-imide is used in the range of 3–20 wt. % by weight of the conductive composition, with a more preferred range of 7–10 wt. %. If less than 5 wt. % resin is used, the resulting conductive composition has poor screen printing properties as well as weak mechanical properties and poor adhesion. If more than 15 wt. % is used, the resulting composition has less electrical conductive property.

Aromatic cyanate ester is a high temperature thermosetting polymer. Aromatic cyanate esters are commercially available from Lonza Chemicals. Cyanate ester resins in the range of 0–10wt. % are used. The amount of cyanate ester resin in the composition is determined by the application requirements. Increasing the amount of cyanate ester decreases flexibility, but improves temperature performance at high temperature. Depending on the amount of cyanate ester, the cured film can either behave as a molecular composite, a semi-interpenetrating network, or an immiscible blend. This versatility in morphology can be judiciously chosen for a given application.

2. Conductive Component

The electrically conductive component of the present invention comprises finely divided particles of electrically conductive materials such as silver, copper, nickel, conductive carbon, graphite or mixtures thereof. This includes mixtures of the metallic and carbon powders. Silver flakes are the preferred conductive component among all other conductive particles listed above. Silver flake particles with average particle size in the range of 0.1–10 microns are preferably used. Higher silver particle size leads to higher surface roughness. The conductive particles comprise 40–85 wt. % of the conductive composition with a preferred range of 60–70 wt. %. The preferred silver flake is commercially available from Degusaa Corporation.

3. Organic Vehicle

An organic solvent of 20–40 wt. % is used to dissolve the conductive composition. The preferred solvent used in the conductive composition is N-methyl pyrrolidone. The selection of the solvent is based on the good solubility of the polymer in this solvent. This solvent also has a high boiling point. Low evaporation of the solvent is preferred for continuous printing operation where no change in viscosity of the composition due to loss of solvent is desired. The polymer is dissolved completely in prior to blending with silver particles. The preferred N-methyl pyrrolidone is commercially available from BASF Corporation.

4. Other Additives

Surfactants such as fluorinated oligomers may be added to the composition for wettability and leveling properties. Up to 1 wt. % of a fluorinated surfactant may be used. The fluorinated oligomers are commercially available from 3M Corporation.

Rheological additives such as Thixatrol plus, Bentone 52, and others are sometimes added to tailor rheological properties for different processing applications. Typical levels of use for effective flow control range from 0–2.0 wt. % of the total composition. These rheological additives are commercially available from Rheox Inc.

5. General Composition Preparation and Printing Procedures

In the preparation of the composition of the present invention, the electrically conductive metallic particles are mixed with the a polymer solution. The polymer solution is made by mixing 3–20 wt. % of a polyamide-imide polymer and 0–10 wt. % cyanate ester resin in 20–40 wt. % N-methyl pyrrolidone based upon total composition. The polymer solution is mixed in a roller mixer for 6 hours. Electrically conductive metallic particles are mixed with polymer solution. The polymer and metallic particles are then fed to a three-roll mill to form a paste with fine particle size. At this point the surfactants and rheological additives may be added if desired to modify the properties of the conductive composition. The paste was milled for 10–30 minutes. Another method of mixing that can be used is using high-speed shear to thoroughly blend the conductive particles in the polymer binder. Three-roll mill mixing is preferred for preparing conductive composition with uniform particle size. The particle size range and viscosity of the paste is monitored to get a conductive paste suitable for application in position sensors. The milling time and milling quantity on the three roll mill determines the final particles distribution and size and resulting rheology.

The conductive paste thus prepared is applied to substrates such as polyimide, ceramic and fiber reinforced phenolic substrates by conventional screen printing processes. A preferred substrate is polyimide. The wet film thickness typically used for position sensor application is 40 microns. The wet film thickness is determined by the screen mesh and screen emulsion thickness. A preferred screen mesh of 325 is used for obtaining smooth conductive film on a polyimide substrate for position sensors. The wet film is then cured in a convection oven at a temperature range of 200–300 degrees Celsius for 10–30 minutes. Preferred curing conditions for conductive film on a phenolic substrate is 220 degrees Celsius for 15 minutes. Preferred curing conditions for conductive film on a polyimide and alumina substrate is 300 degrees Celsius for 10 minutes.

6. Test Procedures

Viscosity Measurements

The rheological properties of the conductive composition were measured using an SR-5 rheometer. The viscosity was measured as a function of shear rate using 25 cm parallel plate geometry at 25 degrees C.

Resistivity

The resistance of the conductive strip on a substrate was measured by the four point probe method. The Resistivity was calculated from the resistance, cross sectional area and length of the conductive strip.

Thermal Properties

The decomposition temperature was measured to determine the thermal stability of the conductive film under subsequent processing conditions. The weight loss in percentage was determined using a Perkin Elmer TGA.

Dynamic Thermal Properties

The changes in mechanical property of the conductive film was measured by a dynamic mechanical analysis instrument. The storage and loss modulus as a function of temperature was measured to determine glass transition temperature of the free standing film prepared from the conductive composition.

Adhesion

The adhesion of the conductive film to different substrates was measured by a cross hatch adhesion test. On the conductive strip, a series of parallel and perpendicular scribes were made using a razor blade. A Scotch Magic Tape No. 810 is affixed to the scribed area. The conductive film surface was examined after pulling the tape off from the conductive film surface. Loss of adhesion (fail) would be shown by lifting and removal of an individual square of conductive film from the cross hatches.

Mechanical Properties

Mechanical properties of the free standing film were measured by an Instron tensile tester. Free standing films from some of the example compositions could not be prepared due to brittleness of the cured film.

EXAMPLES

The present invention will be described in further detail by giving practical examples. The scope of the present invention, however, is not limited in any way by these practical examples.

Example 1

This example describes the preparation of a silver conductive composition using a fine silver flake with an average particle size of 5 microns. The components below were added to a 50-ml jar with mixing. The mixture was then roller milled in a three-roll mill for 30 minutes. The rheology of the resulting paste was a measured by a SR-5 rheometer using a parallel plate geometry. The viscosity at 1s-1 was 97,367 centipoise and 24,750 centipoise at 100s-1. The silver paste is then screen printed on alumina and polyimide substrates, dried and cured. The resulting film was tested for the following parameters Viscosity, Resistivity, Adhesion, Tensile Modulus, Strain at Break, Tensile Strength, Storage Modulus and TGA. The results of the testing for these parameters are shown in table 1.

| Component | Weight (%) |
|---|---|
| Polyamide imide | 7.4 |
| Silver flake | 64 |
| N-methyl pyrrolidone | 28.6 |

Example 2

This example describes the preparation of a silver conductive composition using a fine silver flake with an average particle size of 5 microns. The components below were added to 50 ml jar with mixing. The mixture was then roller milled in a three roll mill for 30 minutes. The rheology of the resulting paste was a measured by an SR-5 rheometer. The silver paste is then screen printed on alumina and polyimide substrate, dried and cured. The resulting film was tested for the following parameters Viscosity, Resistivity, Adhesion, Tensile Modulus, Strain at Break, Tensile Strength, Storage Modulus and TGA. The results of the testing for these parameters are shown in table 1.

| Component | Weight (%) |
|---|---|
| Polyamide imide | 6.66 |
| Cyanate Ester | 0.74 |
| Silver flake | 64 |
| N-methyl pyrrolidone | 28.6 |

Example 3

This example describes the preparation of a silver conductive composition using a fine silver flake with an average particle size of 5 microns. The components below were added to 50-ml jar with mixing. The mixture was then roller milled in a three-roll mill for 10–30 minutes. The rheology of the resulting paste was a measured by an SR-5 rheometer. The silver paste is then screen printed on alumina and polyimide substrate, dried and cured. The resulting film was tested for the following parameters Viscosity, Resistivity, Adhesion, Tensile Modulus, Strain at Break, Tensile Strength, Storage Modulus and TGA. The results of the testing for these parameters are shown in table 1.

| Component | Weight (%) |
|---|---|
| Polyamide imide | 5.18 |
| Cyanate Ester | 2.22 |
| Silver flake | 64 |
| N-methyl pyrrolidone | 28.6 |

Example 4

This example describes the preparation of a silver conductive composition using a fine silver flake with an average particle size of 5 microns. The components below were added to a 50-ml jar with mixing. The mixture was then roller milled in a three-roll mill for 10–30 minutes. The rheology of the resulting paste was measured by a SR-5 rheometer. The silver paste is then screen printed on alumina and polyimide substrate, dried and cured. The resulting film was tested for the following parameters Viscosity, Resistivity, Adhesion, Tensile Modulus, Strain at Break, Tensile Strength, Storage Modulus and TGA. The results of the testing for these parameters are shown in table 1.

| Component | Weight (%) |
|---|---|
| Polyamide imide | 3.7 |
| Cyanate Ester | 3.7 |
| Silver flake | 64 |
| N-methyl pyrrolidone | 28.6 |

TABLE 1

| Properties | Example 1 | Example 2 | Example 3 | Example 4 |
|---|---|---|---|---|
| Viscosity, Centipoise (At shear Rate $1S^{-1}$) | 97,367 | 81,221 | 37,161 | 14,427 |
| Resistivity (milliohm.cm) | .016 | .027 | .036 | .029 |
| Adhesion (to Kapton, Ceramic, GRPhenolic) | Pass | Pass | Pass | pass |
| Tensile Modulus(GPa) | 6.88 | 7.77 | 4.65 | -brittle films |

TABLE 1-continued

| Properties | Example 1 | Example 2 | Example 3 | Example 4 |
|---|---|---|---|---|
| Strain at Break (%) | 1.28 | 2.6 | O.64 | -brittle films |
| Tensile Strength(MPa) | 54.7 | 140 | 26.9 | -brittle films |
| Storage Modulus(GPa) At 1Hz, RT | 6.36 | 7.36 | 3.64 | 4.06 |
| Storage Modulus(GPa) At 1Hz, 250C | 3.9 | 5.77 | 2.91 | 2.9 |
| TGA (Weight Loss at 400C) | 0.9% | 0.7% | 0.6% | 0.7% |

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A conductive composition, based on total composition, comprising:

a) 3–20 wt. % of polyamide-imide resin;

b) greater than 0 up to and including 10 wt % cyanate ester resin; and c) 40–85 wt. % finely divided electrically conductive particles selected from the group consisting of silver, copper, nickel, silver coated copper, silver coated nickel, carbon black, graphite and mixtures thereof, wherein all of (a), (b) and (c) are dispersed in a 20–40 wt. % organic solvent.

2. The polymer film conductive composition according to claim 1, wherein the electrically conductive particles are 60–70 wt. % of the total composition and are selected from the group consisting of silver, copper, nickel, silver coated copper, silver coated nickel and mixtures thereof.

3. The polymer film conductive composition according to claim 1, wherein the organic solvent is N-methyl Pyrrolidone.

4. The polymer film conductive composition according to claim 1, further comprising 0–1 wt. % flourochemical surfactant to improve wettability.

5. The polymer film conductive composition according to claim 1, further comprising 0–2 wt. % rheological additive to modify viscosity of the conductive composition.

6. The polymer film conductive composition according to claim 2, wherein the electrically conductive particles have a particle size of 0.1–10 microns.

7. The polymer film conductive composition according to claim 5, wherein the electrically conductive particles are silver flakes.

8. The polymer film conductive composition according to claim 1, wherein the electrically conductive particles are carbon black or graphite.

9. The polymer film conductive composition according to claim 1, wherein the electrically conductive composition is applied to a substrate is chosen from the group consisting of polyimide, ceramic and fiber reinforced phenolic substrates.

10. The polymer film conductive composition according to claim 8, wherein the electrically conductive composition on the substrate is used in a position sensor.

11. The polymer film conductive composition according to claim 1, wherein the electrically conductive composition is cured at a temperature range from 200 degrees Celsius to 300 degrees Celsius.

12. The polymer film conductive composition according to claim 11, wherein the electrically conductive composition has a cure time between 10 and 30 minutes.

13. A conductive composition for coating on a substrate, based on total composition, comprising:

a) 3–20 wt. % of polyamide-imide resin;

b) greater than 0 up to and including 10 wt % cyanate ester resin;

c) 40–85 wt. % finely divided electrically conductive particles selected from the group consisting of silver, copper, nickel, silver coated copper, silver coated nickel, carbon black, graphite and mixtures thereof;

d) 20–40 wt. % organic solvent, wherein all of (a), (b), and (c) are dispersed in the organic solvent;

e) 0–1 wt. % flourochemical surfactant to improve wettability of the conductive composition; and f) 0–2 wt. % rheological additive to modify viscosity of the conductive composition.

14. The polymer film conductive composition according to claim 13, wherein the electrically conductive particles are 60–70 wt. % of the total composition and are selected from the group consisting of silver, copper, nickel, silver coated copper, silver coated nickel and mixtures thereof.

15. The polymer film conductive composition according to claim 13 wherein the organic solvent is N-methyl Pyrrolidone.

16. The polymer film conductive composition according to claim 12, wherein the electrically conductive particles have a particle size of 0.1–10 microns.

17. The polymer film conductive composition according to claim 14, wherein the electrically conductive particles are silver flakes.

18. The polymer film conductive composition according to claim 13, wherein the substrate is chosen from the group consisting of polyimide, ceramic and fiber reinforced phenolic substrates.

19. The polymer film conductive composition according to claim 18, wherein the electrically conductive composition on the substrate is used in a position sensor.

20. The polymer film conductive composition according to claim 13, wherein the electrically conductive composition is cured at a temperature range from 200 degrees Celsius to 300 degrees Celsius for a cure time between 10 and 30 minutes.

* * * * *